US010799041B1

(12) United States Patent
Lawson et al.

(10) Patent No.: US 10,799,041 B1
(45) Date of Patent: Oct. 13, 2020

(54) WALL MOUNTED ORGANIZER RACK

(71) Applicant: TAG Hardware Systems Ltd., Surrey (CA)

(72) Inventors: Stephen Lawson, Surrey (CA); Sergio Ullod, Vancouver (CA)

(73) Assignee: Tag Hardware Systems Ltd., Surrey, BC (CA)

( * ) Notice: Subject to any disclaimer, the term of this patent is extended or adjusted under 35 U.S.C. 154(b) by 0 days.

(21) Appl. No.: 16/365,351

(22) Filed: Mar. 26, 2019

(51) Int. Cl.

| | |
|---|---|
| ***A47F 5/08*** | (2006.01) |
| ***A47B 57/58*** | (2006.01) |
| ***A47B 61/02*** | (2006.01) |
| ***A47F 5/10*** | (2006.01) |

(52) U.S. Cl.
CPC ..... *A47F 5/0815* (2013.01); *A47B 57/585* (2013.01); *A47B 61/02* (2013.01); *A47F 5/0838* (2013.01); *A47F 5/0853* (2013.01); *A47F 5/103* (2013.01); *A47B 2220/0036* (2013.01)

(58) Field of Classification Search
CPC .... A47F 5/0853; A47F 5/0815; A47F 5/0838; A47F 5/08; A47F 5/0884; A47F 5/103; A47F 7/02; A47B 57/585; A47B 2220/0036; A47B 96/14; A47B 96/1433; A47B 96/1441; A47B 96/145; A47B 96/1466; A47B 2096/1491; A47B 61/02; A47B 57/44; A47B 57/54; E04H 17/143; E04H 17/1434; E04H 2017/146
USPC ..... 211/87.01, 94.01, 106.01, 88.04, 6, 16, 211/85.2; 248/298.1, 220.21, 220.22, 248/220.31, 220.41, 222.42, 224.8; 411/84, 104, 400, 401
See application file for complete search history.

(56) References Cited

U.S. PATENT DOCUMENTS

| | | | | |
|---|---|---|---|---|
| 3,388,806 A * | 6/1968 | Cunningham, Jr. | ..... | D01H 1/18 211/85.5 |
| 3,397,866 A * | 8/1968 | Hockett | ..... | E04H 17/1434 256/22 |
| 3,830,374 A * | 8/1974 | Kassimir | ..... | A47F 5/103 211/1 |

(Continued)

OTHER PUBLICATIONS

TAG Hardware Systems Ltd.—In-house research summary document with links to websites (undated).

(Continued)

*Primary Examiner* — Jennifer E. Novosad
(74) *Attorney, Agent, or Firm* — Oyen Wiggs Green & Mutala LLP

(57) ABSTRACT

A wall-mountable organizer rack having two or more vertical bars and one or more horizontal bars in which each horizontal bar has a rear central channel. The rear central channel of each horizontal bar has a channel mouth and a channel front wall, and the height of the channel front wall is greater than the height of the channel mouth for substantially all of the length of each horizontal bar. Bar fasteners inserted into the rear central channel from the vertical bars to fix the vertical bars to the horizontal bars may have at least one dimension that is larger than the height of the channel mouth to fix the fasteners within the channel. Organizer rack attachments inserted into the rear central channel may have at least one dimension that is larger than the height of the channel mouth to secure the attachments within the channel.

8 Claims, 13 Drawing Sheets

(56) References Cited

U.S. PATENT DOCUMENTS 4,401,222 A * 8/1983 Kulikowski ..... A47F 5/0025 211/94.01
4,869,378 A * 9/1989 Miller ..... A47F 5/0853 211/94.01
4,964,618 A * 10/1990 Kennedy ..... E01F 8/007 256/24
5,048,698 A * 9/1991 Konrad ..... A47F 5/0846 211/103
5,242,048 A * 9/1993 Ellingsworth ..... A47F 7/02 206/495
5,392,934 A * 2/1995 Fox ..... A47B 95/008 211/103
5,396,846 A * 3/1995 Kelly ..... A47B 13/16 108/91
5,582,116 A * 12/1996 Spimpolo ..... A47B 96/00 108/108
5,695,174 A * 12/1997 Tsai ..... E04H 12/2215 256/19
5,740,927 A * 4/1998 Yemini ..... A47B 96/067 211/66
5,769,247 A * 6/1998 Merl ..... A47B 47/022 211/103
5,794,795 A * 8/1998 Stemmons ..... H02B 1/01 211/191
5,950,974 A * 9/1999 Hoffmann ..... H02B 1/202 248/223.41
6,068,135 A * 5/2000 Holztrager ..... A47F 5/0846 211/4
6,246,004 B1 * 6/2001 Faccin ..... H02B 1/202 174/95
6,279,761 B1 * 8/2001 Niewiadomski .... G09F 15/0087 211/116
6,398,149 B1 * 6/2002 Hines ..... A47B 21/06 242/388.6
6,435,357 B1 * 8/2002 Lee ..... A47F 5/0838 211/70.6
6,871,749 B2 * 3/2005 Bostick ..... A47G 25/746 211/94.01
7,300,029 B2 * 11/2007 Petrick ..... F16M 11/10 248/285.1
7,591,385 B2 * 9/2009 Brooks ..... A47F 5/0846 211/70.6
7,604,131 B1 * 10/2009 Clark ..... B62H 3/12 211/118
7,861,986 B2 * 1/2011 Cline ..... E04B 2/7416 211/94.01
7,921,615 B2 * 4/2011 Picchio ..... A47B 95/008 211/162
8,061,539 B2 * 11/2011 Punzel ..... A47B 57/10 108/108
8,272,609 B2 * 9/2012 Chan ..... H01L 23/4006 248/298.1
8,276,860 B2 * 10/2012 Ye ..... H05K 7/20172 248/200
8,474,632 B2 * 7/2013 Yang ..... A47K 3/281 211/119.009
8,998,009 B2 * 4/2015 Kim ..... A47B 95/008 211/103
9,125,502 B2 * 9/2015 Gwag ..... A47F 5/0884
9,545,716 B2 * 1/2017 Hsieh ..... B25H 3/04
D785,373 S * 5/2017 McCann ..... D6/641
9,822,925 B2 * 11/2017 Helmikkala ..... F16M 11/045
9,948,072 B2 * 4/2018 Lutze ..... H02B 1/052
10,098,479 B1 * 10/2018 Muellerleile ..... A47F 5/103
2003/0192845 A1 * 10/2003 Lawson ..... A47F 5/0846 211/94.01
2006/0240707 A1 * 10/2006 Bre' ..... H02B 1/052 439/532
2007/0056921 A1 * 3/2007 Lo ..... F16M 13/02 211/94.01
2007/0079561 A1 * 4/2007 Hopkins ..... A47F 5/0846 52/36.5
2007/0251904 A1 * 11/2007 Winig ..... A47B 96/06 211/106.01
2010/0122963 A1 * 5/2010 Costa ..... A47G 25/746 211/94.01
2010/0326930 A1 * 12/2010 Chiang ..... F16M 11/2014 211/26
2011/0260026 A1 * 10/2011 Ye ..... F16M 13/02 248/298.1
2014/0263116 A1 * 9/2014 Wojciechowski .... A47F 5/0807 211/85.2

OTHER PUBLICATIONS

TAG Hardware Systems Ltd.—In-house list of similar products with links to websites (undated).

* cited by examiner

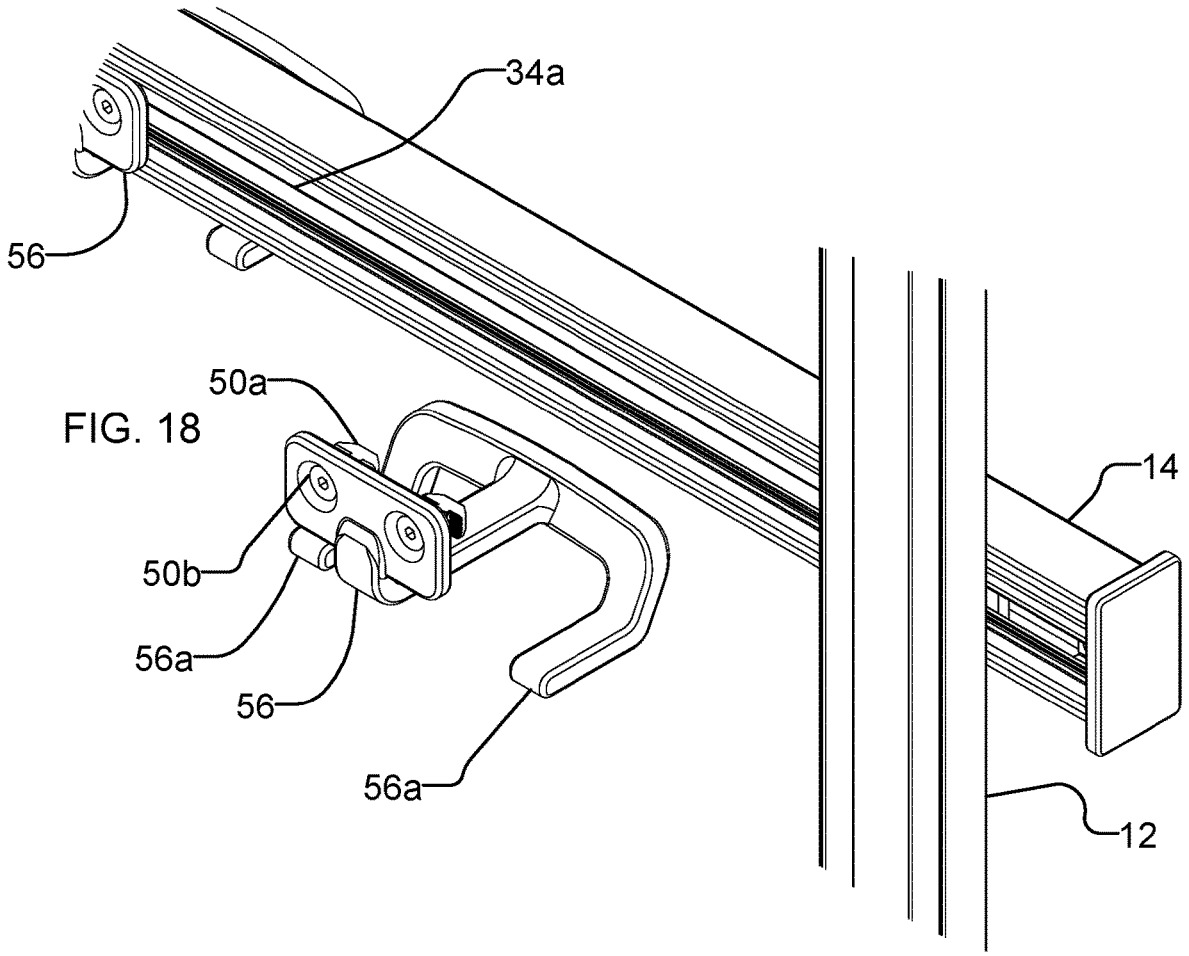
FIG. 18
FIG. 19
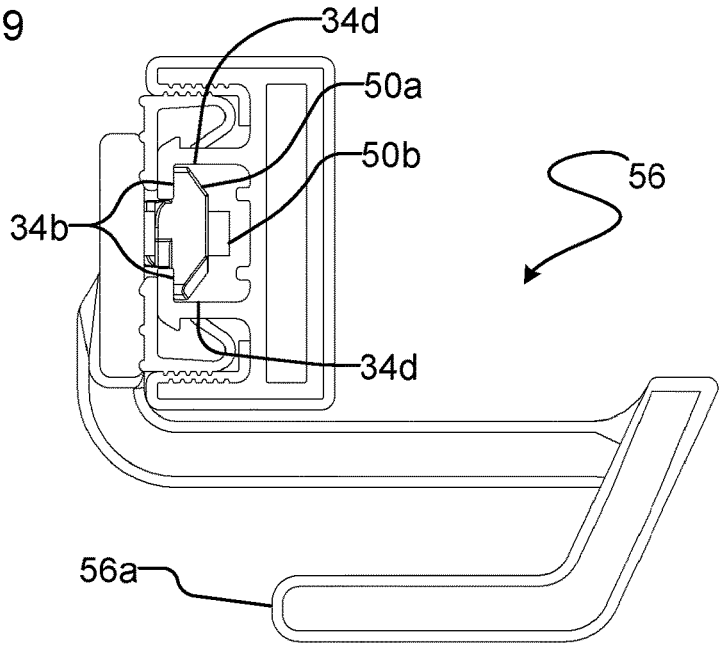

WALL MOUNTED ORGANIZER RACK

TECHNICAL FIELD

This invention relates to a wall-mounted organizer rack. In particular, the invention relates to a wall-mounted organizer that may be used for organizing personal items and articles of clothing such as shoes, ties, scarves, coats, belts, hats, jewelry and bags.

BACKGROUND

Organizer racks of many designs are known in the art. Organizer racks for various purposes may be mounted on walls to provide space in which objects may be suspended for easy access. In some common domestic applications organizer racks may be provided in closets, hallways, garages and kitchens. In commercial circumstances organizer racks may be provided at workstations and in storefronts.

A typical organizer rack might include one or more horizontal bars and one or more attachments from which to suspend items. In some applications an organizer rack might include protrusions shaped to suspend or receive a particular type of object, or might provide a platform on which an object can be placed.

A challenge in the development of a wall organizer is that fasteners and other minor parts can break an otherwise clean look of an organizer and can therefore worsen the aesthetic value. It can be difficult to develop a stable and sturdy organizer that can support potentially significant weight while hiding, as best as possible, any minor parts.

In some previous wall organizers, hooks and other attachments may be permanently fastened by screws from the rear side of a horizontal bar, or may hook around the top of a bar so that they are secured by their own weight and the weight of anything suspended from them. Some of these hooks are disadvantageous in that they are either too difficult to remove, difficult to adjust the distribution across the wall rack for different purposes, or too easy to remove, in that they may be inadvertently dislodged.

The foregoing examples of the related art and limitations related thereto are intended to be illustrative and not exclusive. Other limitations of the related art will become apparent to those of skill in the art upon reading the specification and studying the drawings.

SUMMARY

The following embodiments and aspects thereof are described and illustrated in conjunction with systems, tools and methods which are meant to be exemplary and illustrative, not limiting in scope. In various embodiments, one or more of the above-described problems have been reduced or eliminated, while other embodiments are directed to other improvements.

One aspect of the invention provides an organizer rack in which each horizontal bar connects to one or more vertical bars through fasteners engaging a rear channel in the respective horizontal bar and connecting through a front wall of the vertical bar.

A further aspect of the invention provides an organizer rack in which a fabric is wound tightly around the front wall of a horizontal bar and is secured at each end in one or more rear channels in the horizontal bar by the insertion of one or more corresponding inserts.

An aspect of the invention provides a horizontal bar for an organizer rack, the horizontal bar having a horizontal bar front wall and a horizontal bar rear central channel, the rear central channel including a channel front wall and a channel mouth in which a height of the channel front wall is greater than a height of the channel mouth for substantially all of a length of the horizontal bar. The horizontal bar may further include a fastening structure, the fastening structure connecting into the horizontal bar rear channel and engaging either or both of the channel front wall and the channel mouth to attach the horizontal bar to a structure of the organizer rack. In some embodiments the fastening structure comprises a plate and one or more threaded fasteners, each plate having a length and a height greater than the height of the channel mouth.

In such embodiments the horizontal bar may further include an organizer rack attachment, the organizer rack attachment comprising a support structure and an attachment mechanism. The attachment mechanism may include one or more T-nuts and one or more corresponding threaded fasteners wherein each T-nut has a first dimension in which it is wider than the height of the channel mouth and a second dimension in which it is thinner than the height of the channel mouth. The attachment mechanism may also include a fixed hook and a sliding catch wherein the sliding catch can slide between a first position and a second position and in the first position a combined height of the fixed hook and the sliding catch is greater than the height of the channel mouth.

The horizontal bar may also include a pair of lateral channels, each adjacent to the rear central channel; a pair of inserts; and a fabric cover, wherein the fabric cover is wrapped around the front wall of the horizontal bar and secured behind the horizontal bar by insertion of the inserts in to the lateral channels. The inserts may each comprise a V-shaped portion and a height of the lateral channels is greater than a spread of the V-shaped portion such that insertion of the inserts compresses the inserts and applies pressure to the lateral channel and the fabric cover. The inserts may each comprise a roughened surface and the lateral channels each comprise a roughened surface. The inserts may also each comprise an exterior portion, wherein the exterior portion projects rearwards to provide an engaging surface for a support structure of the organizer rack.

A further aspect of the invention provides an organizer rack fixable to a wall, the organizer rack comprising a number i of horizontal bars, each horizontal bar comprising a horizontal bar front wall and a horizontal bar rear central channel, and each rear central channel comprising a channel front wall and a channel mouth; a number k of vertical bars, each vertical bar comprising a vertical bar front wall; and a vertical bar rear wall; i*k bar fasteners, the bar fasteners indexed as $\{f_{n,m}: n\in\{1, 2 \ldots i\}; m\in\{1, 2 \ldots k\}\}$, the $f_{n,m}$ bar fastener extending from the front wall of the mth vertical bar into the central channel of the nth horizontal bar and engaging either or both of the channel front wall and the channel mouth; four or more stanchions extending in a rearwards direction from the rear walls of two or more of the k vertical bars; wherein a height of the channel front wall is greater than a height of the channel mouth for substantially all of a length of each horizontal bar, i is an integer greater than or equal to one, and k is an integer greater than or equal to two.

In some embodiments of such an organizer rack each of the bar fasteners may comprise a plate and a pair of threaded fasteners, each plate having a length and a height greater than the height of the channel mouth. The organizer rack may further comprise an organizer rack attachment, the organizer rack attachment comprising a support structure and an attachment mechanism. The attachment mechanism may comprise one or more T-nuts and one or more corresponding threaded fasteners wherein each T-nut has a first dimension in which it is wider than the height of the channel mouth and a second dimension in which it is thinner than the height of the channel mouth. The attachment mechanism may comprise a fixed hook and a sliding catch, wherein the sliding catch can slide between a first position and a second position and in the first position a combined height of the fixed hook and the sliding catch is greater than the height of the channel mouth. The stanchions may comprise a male threaded end and one or more stanchions are fixed to one or more of the vertical bars through the rear wall of the vertical bar into a female threaded bolt. The stanchions may further comprise a male threaded end and one or more stanchions are fixed to one or more of the vertical bars through the rear wall of the vertical bar into a female thread of a vertical bar end cap. Each stanchion may comprise a stanchion core and a stanchion exterior, each stanchion core and stanchion exterior being fixable together by a stanchion fastener.

In a yet further aspect of the invention there is provided a method of mounting an organizer rack to a wall comprising assembling an organizer rack, the organizer rack comprising a rack structure and two or more stanchion cores; affixing two or more stanchion exteriors to the wall; lifting the organizer rack to align the stanchion cores with the stanchion exteriors; inserting the stanchion cores into the stanchion exteriors; and fastening the stanchion cores to the stanchion exteriors. The stanchion cores may each further comprise a sharp protrusion and the method may further comprise pressing the assembled organizer rack into the wall at a desired mounting location so that the sharp protrusions mark the relative locations of the stanchion cores.

In addition to the exemplary aspects and embodiments described above, further aspects and embodiments will become apparent by reference to the drawings and by study of the following detailed descriptions.

BRIEF DESCRIPTION OF THE DRAWINGS

Exemplary embodiments are illustrated in referenced figures of the drawings. It is intended that the embodiments and figures disclosed herein are to be considered illustrative rather than restrictive.

FIG. 18 is an isometric view of the rear of part of an organizer rack showing one shoe hook attachment attached and a second shoe hook attachment floating separate from the rack.

FIG. 19 is a cross-sectional view of part of the organizer rack of FIG. 16 through the line E-E with the horizontal bar end cap, the horizontal bar end cap fastener, the vertical bar and the vertical bar end cap hidden in the view.

DESCRIPTION

Figure 1:
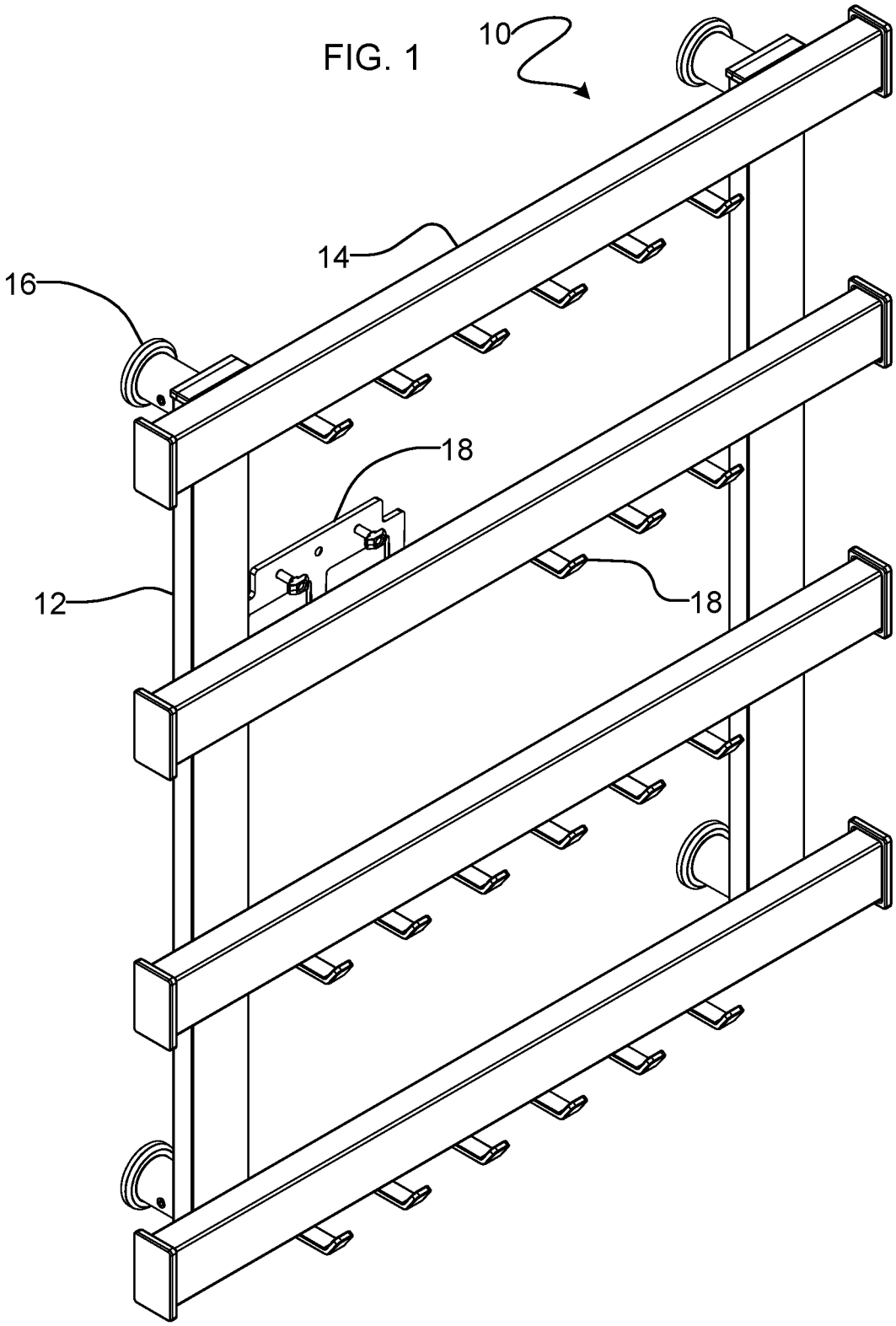
FIG. 1 is an isometric view of an assembled organizer rack with one attachment detached from the organizer rack.

Throughout the following description specific details are set forth in order to provide a more thorough understanding to persons skilled in the art. However, well known elements may not have been shown or described in detail to avoid unnecessarily obscuring the disclosure. Accordingly, the description and drawings are to be regarded in an illustrative, rather than a restrictive, sense.

A table listing each reference numeral with its associated element is provided here.

Table of Reference Numerals

| | |
|---|---|
| 10 | Organizer Rack |
| 12 | Vertical Bar |
| 14 | Horizontal Bar |
| 16 | Stanchion |
| 16a | Stanchion Core |
| 16b | Stanchion Exterior |
| 16c | Stanchion Pin |
| 16d | Stanchion Exterior Hole |

-continued

| Table of Reference Numerals | |
|---|---|
| 16e | Stanchion Core Groove |
| 16f | Stanchion Core Protrusion |
| 16g | Stanchion Exterior Rear Aperture |
| 18 | Attachment Side |
| 20 | (Vertical Bar) Front Side |
| 22 | (Vertical Bar) Rear Side |
| 24 | Vertical Channel |
| 24a | Central Channel |
| 24b | (Vertical Bar) Lateral Channels |
| 26 | Vertical Bar End Cap |
| 30 | Horizontal Bar Front Side |
| 32 | Horizontal Bar Rear Side |
| 34 | (Horizontal Bar) Central Channel |
| 34a | Channel Mouth |
| 34b | Channel Rear Walls |
| 34c | Channel Front Wall |
| 34d | Channel Upper and Lower Walls |
| 36 | Plate |
| 36a | Plate Fasteners |
| 38 | Horizontal Bar End Cap |
| 38a | (Horizontal Bar End Cap) Fastener |
| 40 | (Horizontal Bar) Front Lip |
| 42 | Reinforcing Channel |
| 44 | (Horizontal Bar) Lateral Channels |
| 44a | Roughened Surface |
| 44b | Opposing Wall |
| 44c | Raised Lip |
| 46 | Fabric Covering |
| 48 | Insert |
| 48a | Insert V-shaped Portion |
| 48b | Insert Roughened Surface |
| 48c | Insert Exterior Portion |
| 50 | Basic Hook |
| 50a | T-Nut |
| 50b | Threaded Fastener |
| 52 | Coat Hook |
| 54 | Catch Mechanism |
| 54a | Fixed Hook |
| 54b | Sliding Catch |
| 54c | (Sliding Catch) Raised |
| 54d | (Sliding Catch) Gap |
| 56 | Shoe Hook |
| 56a | Shoe Hook Arm |
| 58 | Shoe Prints |

Turning now to the accompanying drawings, there is shown in FIG. 1 an organizer rack 10. The organizer rack 10 has one or more vertical bars 12 and one or more horizontal bars 14 are fixed to each vertical bar 12. In general each horizontal bar 14 is affixed to and supported by at least two vertical bars 12.

Each vertical bar 12 is offset from a wall or other supporting structure (not shown) by one or more stanchions 16 extending from the rear side of the vertical bar 12 and terminating at the wall. The stanchions 16 may be fixable to the wall by means of any of a variety of positionable anchoring devices such as drywall plugs and screws. An example of a suitable anchoring device is described in U.S. Pat. No. 6,161,999.

Each horizontal bar 14 may support one or more attachments 18. Various attachments may be used and examples of such attachments will be described later herein.

Structure of the Rack

Figure 2:
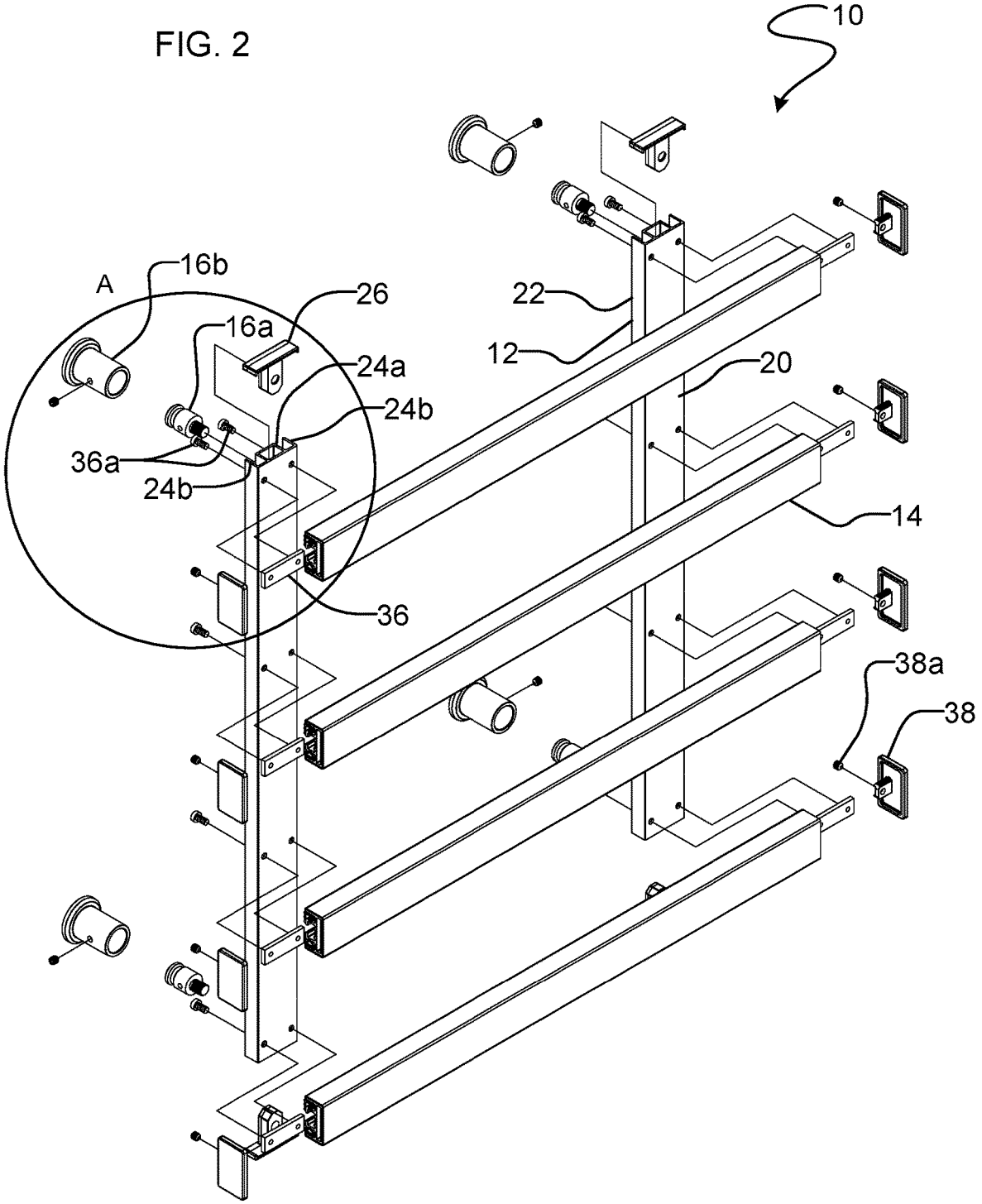
FIG. 2 shows a partially-exploded view of an organizer rack showing the connections that act through the vertical bars.

FIG. 2 shows an exploded view of an exemplary embodiment of the organizer rack. Each vertical bar 12 has a front side 20, and a rear side 22. In the rear side 22 of each vertical bar 12 there is at least one channel 24 down the length of the vertical bar. In the embodiments shown the vertical bar has three channels: one closed central channel 24*a* and two lateral open channels 24*b*. The three channels extend down the length of the vertical bar and have openings at each end. In some embodiments (not shown) there could be only a single channel occupying the rear side 22 of the vertical bar 12.

Figure 3:
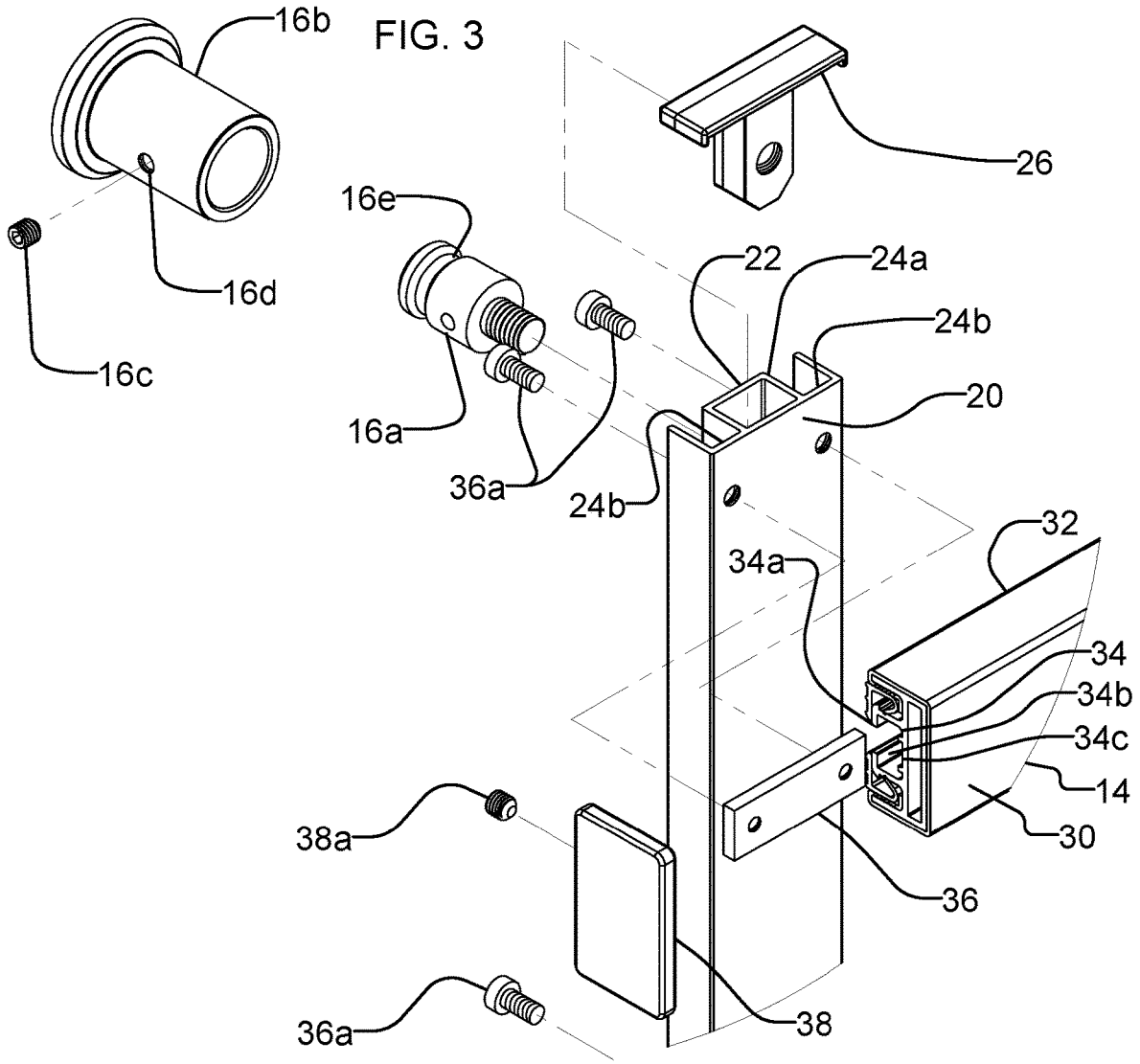
FIG. 3 shows an expanded view of detail A from FIG. 2.
Figure 4:
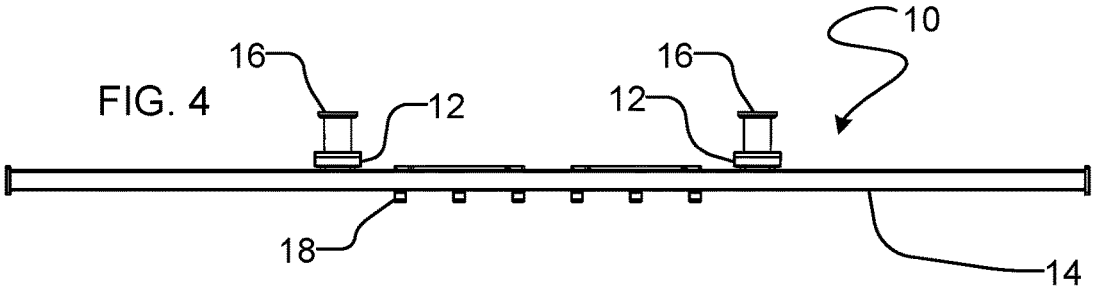
FIG. 4 shows a top view of an assembled organizer rack.
Figure 5:
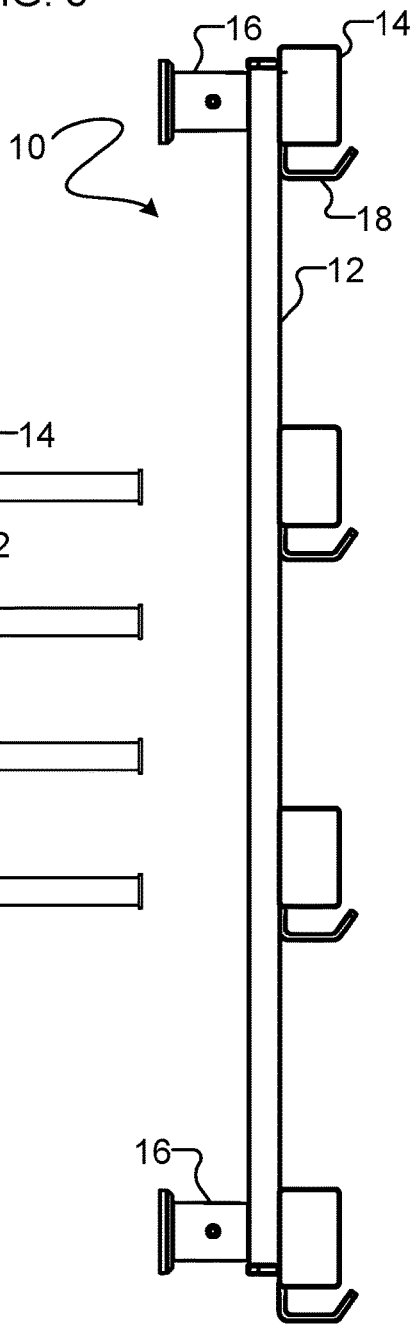
FIG. 5 shows a side view of an assembled organizer rack.
Figure 6:
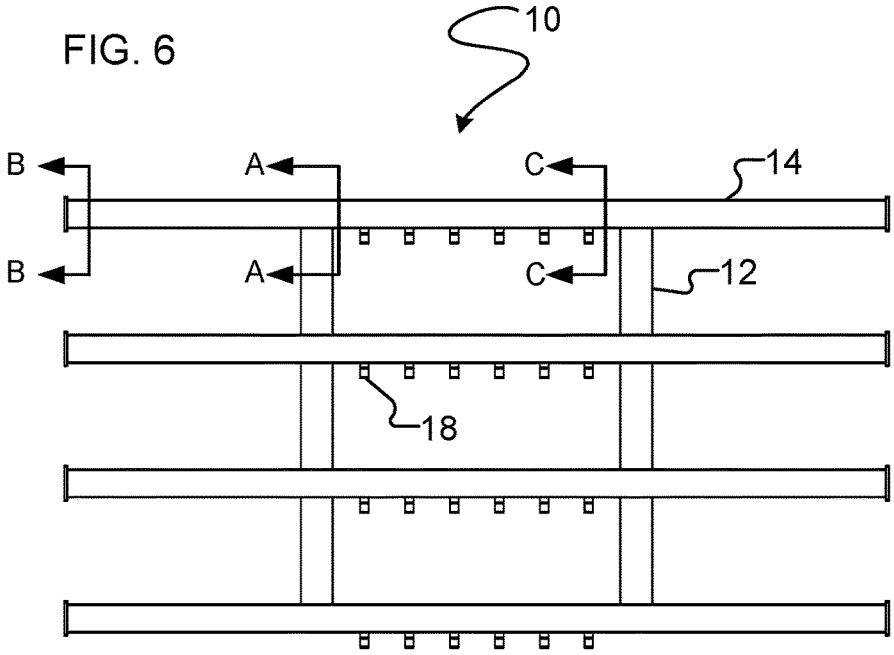
FIG. 6 shows a front view of an assembled organizer rack.

FIG. 3 shows a more detailed view of the structure and attachments of the vertical bar 12, horizontal bar 14 and stanchion 16. Stanchion 16 attaches to the vertical bar by fastening into the rear side 22 of vertical bar 12. A stanchion 16 may have a stanchion core 16*a* and stanchion exterior 16*b* wherein the stanchion core 16*a* threads into the central channel 24*a*. The stanchion exterior 16*b* can be placed over the stanchion core 16*a* and secured in place by a stanchion pin 16*c*. The stanchion pin 16*c* threads into stanchion exterior hole 16*d* and catches stanchion core groove 16*e*, fixing the stanchion core 16*a* and stanchion exterior 16*b* relative to each other.

In the embodiments shown, the stanchion core 16*a* passes through a clearance hole in central channel 24*a* and then threads into vertical bar end cap 26, thereby simultaneously securing the stanchion 16 to the vertical bar 12 and the vertical bar end cap 26 to the end of the stanchion. In wall organizers of extended height or length additional stanchions may be desirable to distribute the weight of the rack across more points of attachment. In such circumstances a stanchion 16 may attach into the central channel 24*a* without attaching further into a vertical bar end cap 26. Instead, a fastener component such as a nut (not shown) may be dropped into the central channel 24*a* for the stanchion to thread into.

While the stanchion 16 has been described with reference to the central channel 24*a*, it should be understood that this is not necessary in all embodiments of organizer rack. For example, in some embodiments a stanchion could thread into a threaded hole in a solid section of the rear side 22 of a vertical bar 12.

Figure 7:
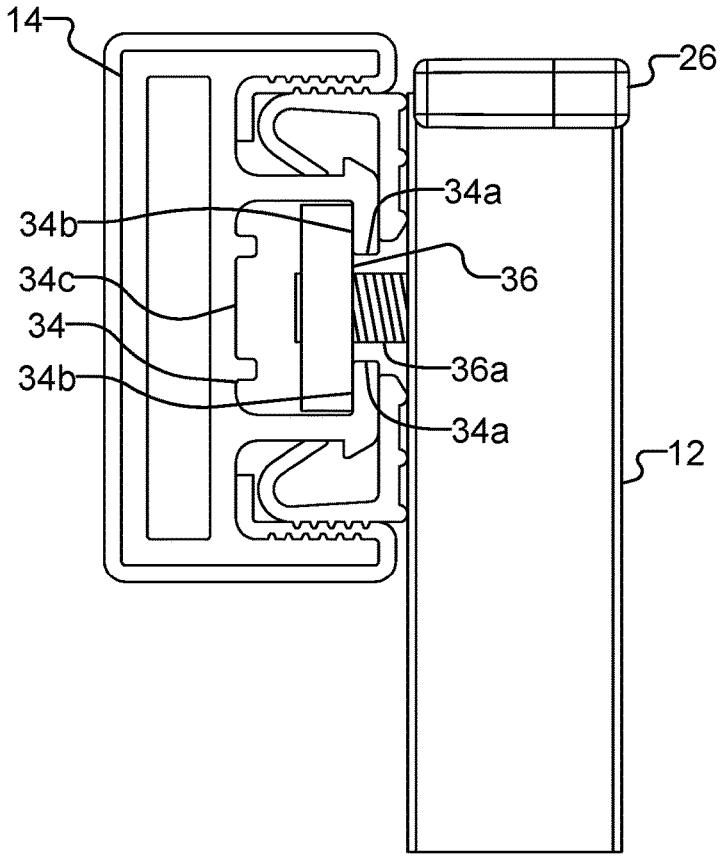
FIG. 7 shows a cross-sectional view of part of the organizer rack of FIG. 6 through the line A-A with the horizontal bar end cap and horizontal bar end cap fastener hidden.

The horizontal bar 14 attaches to the front side 20 of the vertical bar 12. The horizontal bar 14 has a front side 30, a rear side 32, and at least one rear channel 34. The mouth 34*a* of the rear channel is shorter than the height of the interior space of the rear channel. To affix the horizontal bar 14 to a vertical bar 12 a plate 36 is inserted into an end of the rear channel 34 of the horizontal bar. The plate is taller than the channel mouth 34*a*, shown in more detail in FIG. 7. The plate has at least one hole for one or more plate fasteners 36*a* (e.g. threaded fasteners such as screws) to be inserted through the vertical bar 12, through the channel mouth 34*a* and into the plate 36. Rotation of the fasteners 36*a* thereby pulls the plate 36 towards the vertical bar 12, the plate catches on the rear interior walls 34*b* of the channel, and thereby fastens horizontal bar onto the vertical bar.

Figure 8:
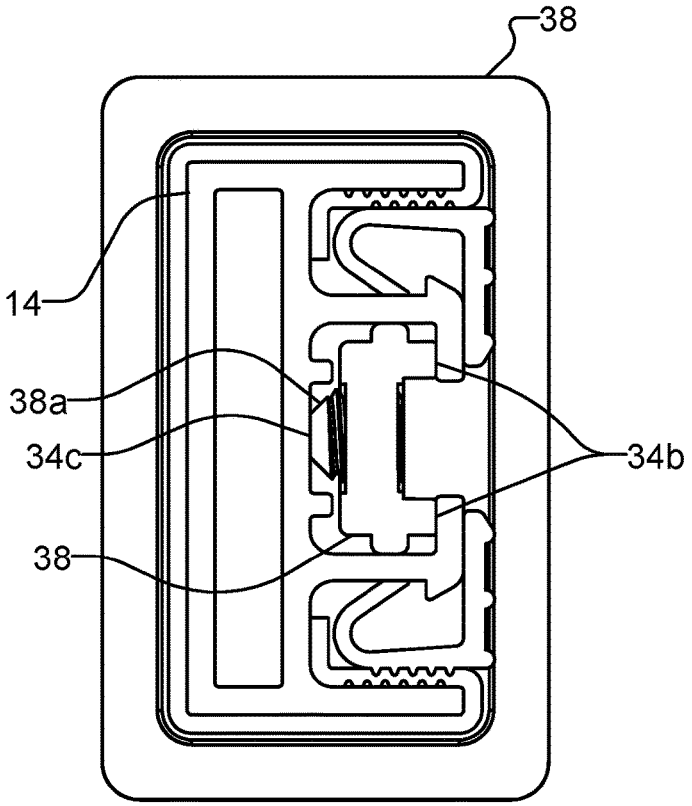
FIG. 8 shows a cross-sectional view of part of the organizer rack of FIG. 6 through the line B-B.

A horizontal bar end cap 38 may be partially inserted into an end of the rear channel 34, as shown in FIG. 8. The horizontal bar end cap includes a fastener 38*a* such as a screw. The fastener 38*a* can be tightened so that it presses into the front interior wall 34*c* of the channel 34. This in turn causes the rear part of the inserted portion of the horizontal bar end cap 38 to press on the rear interior walls 34*b* of the channel 34. The opposing forces and the resulting friction secure the horizontal bar end cap on the horizontal bar. Removing the horizontal bar end cap 38 can be accomplished by loosening the fastener 38*a*.

The Horizontal Bar

Figure 9:
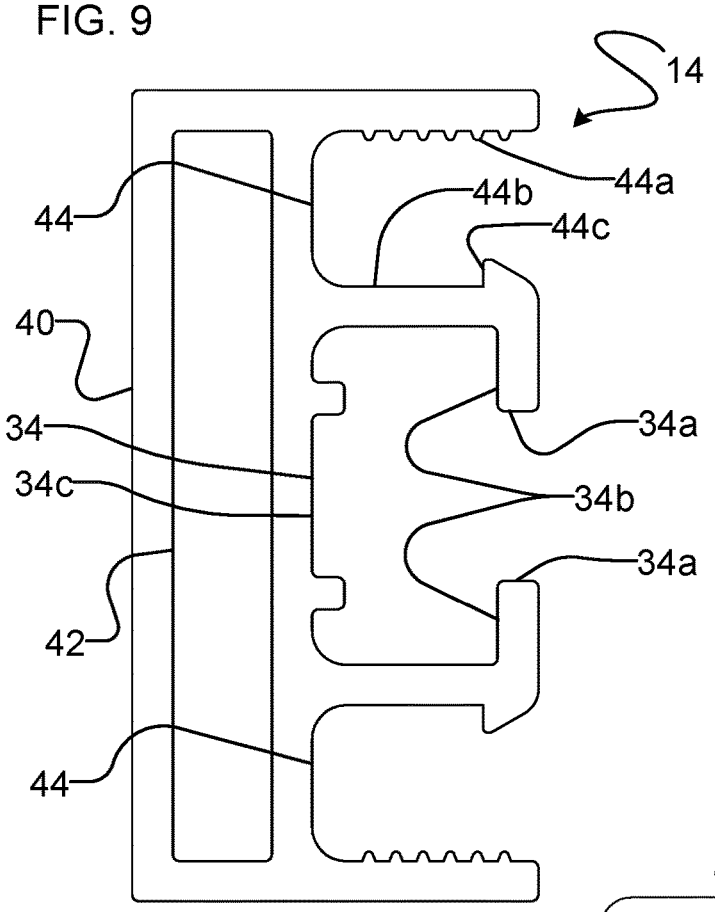
FIG. 9 shows a cross-sectional view of a horizontal bar.

FIG. 9 shows a profile view of a horizontal bar 14 of an embodiment of an organizer rack. The horizontal bar 14 has a front face 40, and may have a reinforcing channel 42. The reinforcing channel is hollow, providing structural reinforcement while also reducing the overall weight of the horizontal bar. In some embodiments the horizontal bar may have two lateral channels 44. The lateral channels 44 may each include a roughened surface 44*a*. The lateral channels 44 can provide points at which to secure a fabric covering for the bar, shown in in FIG. 10.

Figure 10:
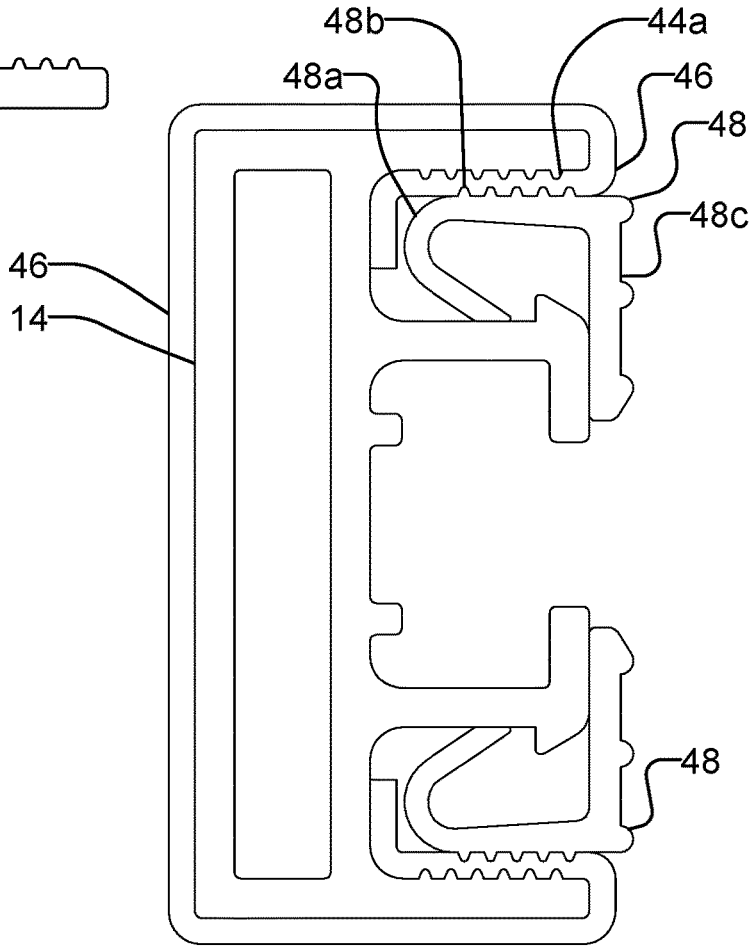
FIG. 10 shows a cross-sectional view of a fabric-wrapped horizontal bar.

A fabric covering 46 can be wrapped around the front face 40 of the horizontal bar and be wrapped around on each side into the lateral channels where the ends of the fabric are secured. The fabric covering 46 may be secured at each end by the insertion of an insert 48. In one embodiment, the inserts are made of a resilient material with limited flexibility and are sized to be at least slightly too large in the vertical dimension to fit into the lateral channel alongside the fabric covering 46. Insertion of the inserts therefore requires compression of the inserts and therefore wedges the inserts 48 in the lateral channels 44, applying pressure to the fabric covering. As shown in FIG. 10, one possible cross-section for the inserts 48 includes a V-shaped portion 48*a*. A surface 48*b* of the inserts 48 opposing a roughened surface 44*a* of the lateral channel 44 may also be roughened or ridged to assist in gripping the fabric covering 46 between the insert 48 and the walls of the lateral channel 44. The opposing wall 44*b* opposite the roughened surface 44*a* of the lateral channel may incorporate a raised lip 44*c*. The raised lip 44*c* may assist in preventing the insert 48 from being inadvertently removed.

The inserts 48 may also have an exterior portion 48*c*. This exterior portion may provide a surface that projects rearwards from the horizontal bar and that engages the front side 20 of the vertical bar when the organizer rack is assembled (see, for example, in FIG. 7).

Attachments

Figure 11:
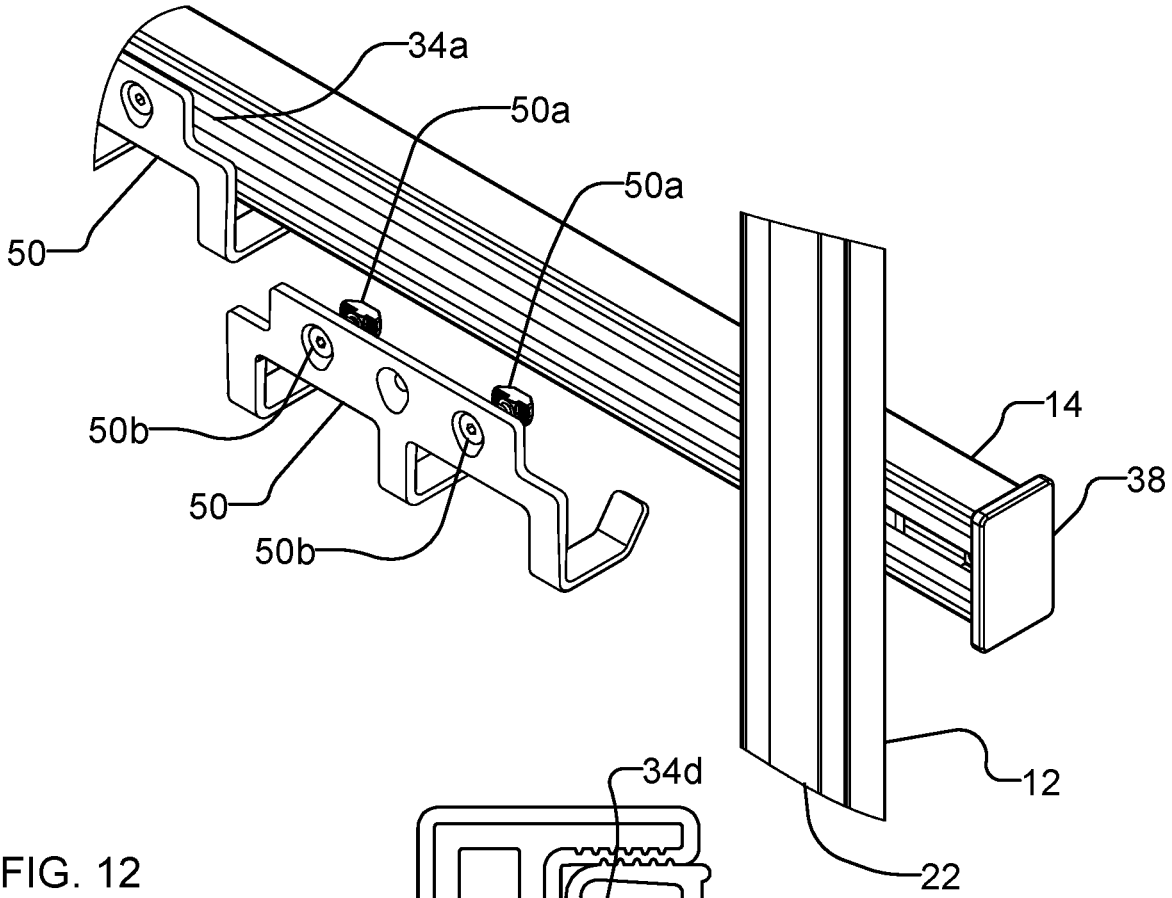
FIG. 11 is an isometric view of the rear of part of an organizer rack showing one basic hook attachment attached and a second basic hook attachment floating separate from the rack.
Figure 12:
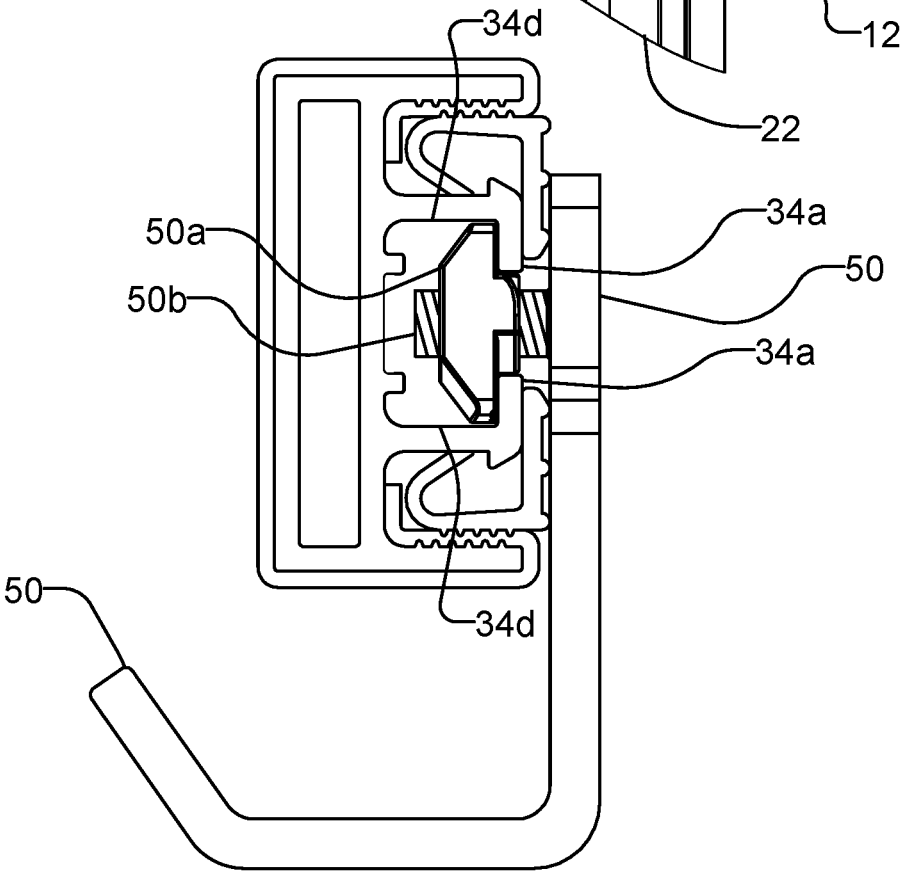
FIG. 12 shows a cross-sectional view of part of the organizer rack of FIG. 6 through the line C-C.

The rear channel 34 of the horizontal bar 14 may support a variety of possible attachments 18. FIGS. 11 and 12 show a basic hook attachment 50 that can be attached to the horizontal bar.

The basic hook 50 attaches into the horizontal bar 14 from the rear side using T-nuts 50*a*. The T-nuts are wider than they are tall, such that their width is greater, and their height is less, than the height of the channel mouth 34*a*. When the threaded fasteners 50*b* in the rear of the basic hook 50 are tightened the T-nuts initially rotate by up to 90°, but catch on the upper and lower walls 34*d* of the channel 34. Further tightening the threaded fasteners 50*b* compresses the interior walls 34*b* between the T-nuts 34*a* and the rear portion of the basic hook, fixing it in place.

Figure 13:
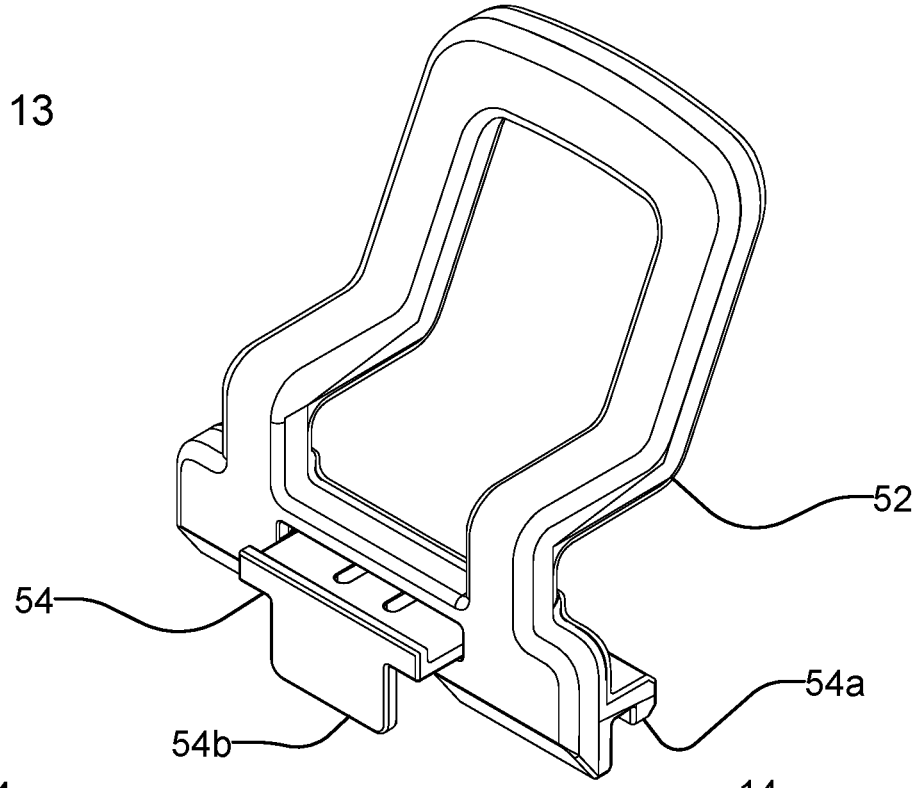
FIG. 13 shows an isometric view of a coat hook with a catch mechanism according an embodiment of the invention.
Figure 14:
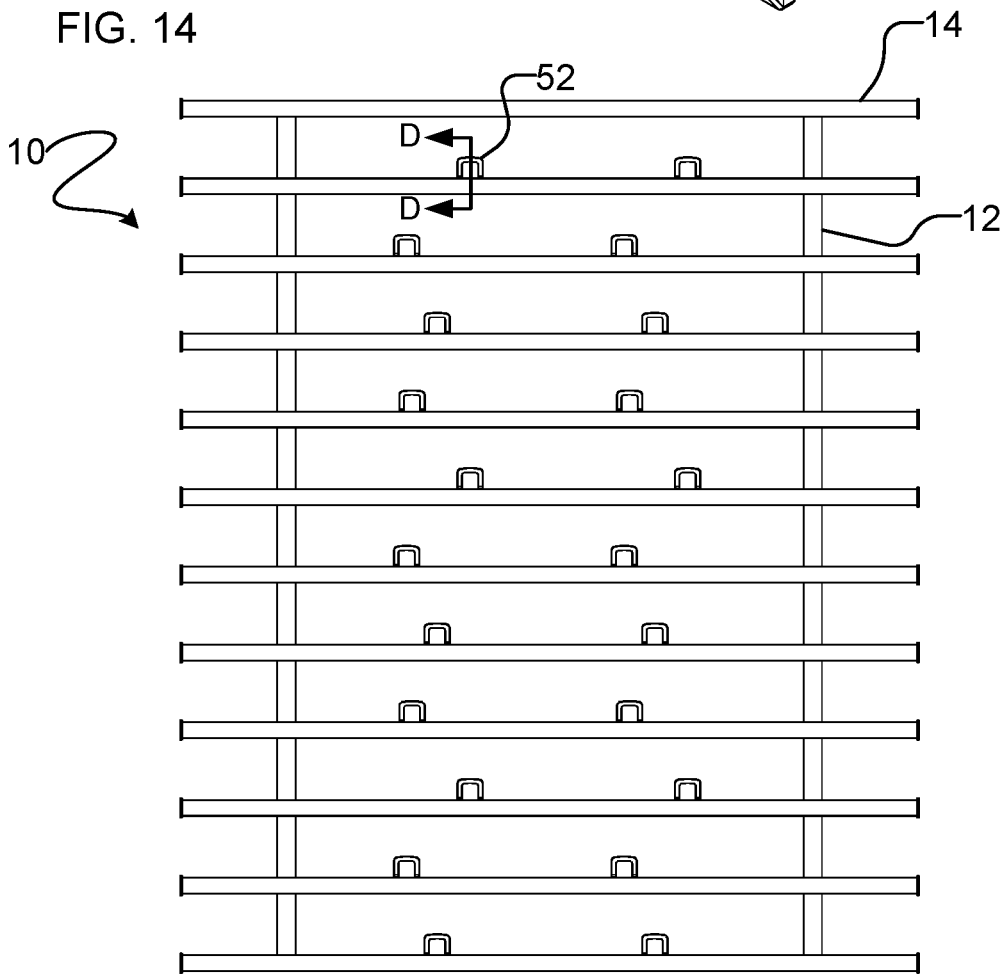
FIG. 14 shows a front view of an assembled organizer rack with distributed coat hooks.
Figure 15A:
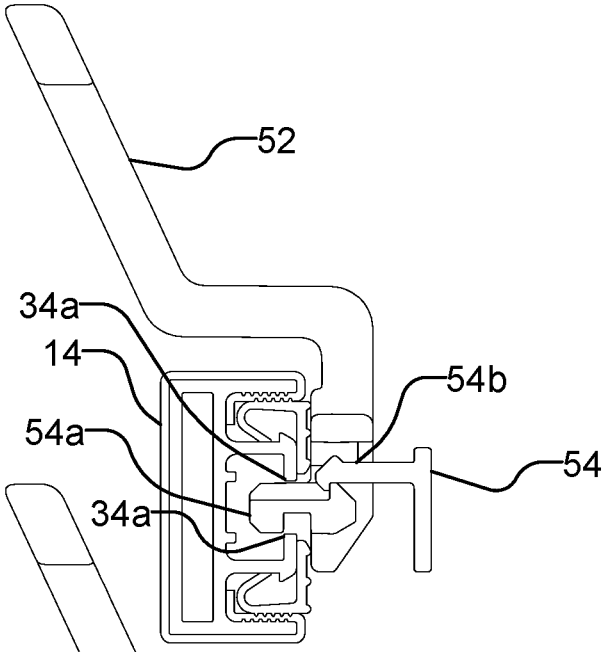
FIGS. 15*a*, 15*b*, and 15*c* show a series of cross-sectional views of part of the organizer rack of FIG. 14 through the line D-D illustrating the operation of a catching mechanism. In each of FIGS. 15*a*, 15*b*, and 15*c*, a horizontal bar end cap, a horizontal bar end cap fastener, a vertical bar and a vertical bar end cap are hidden in the views.
Figure 15B:
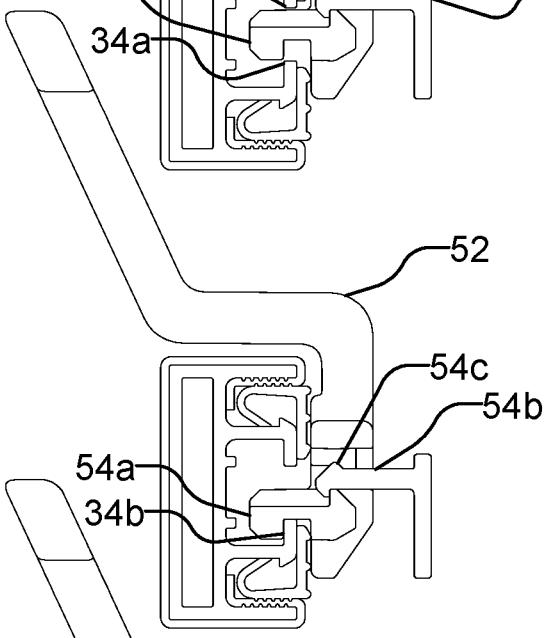
Figure 15C:
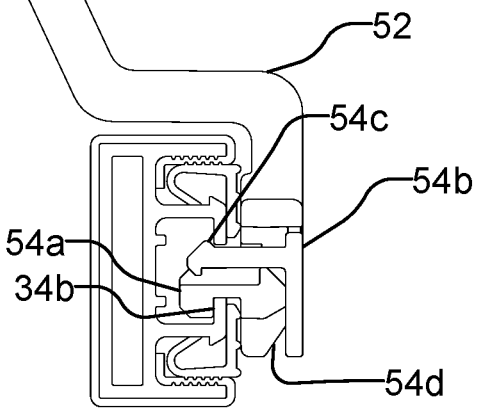
Figure 16:
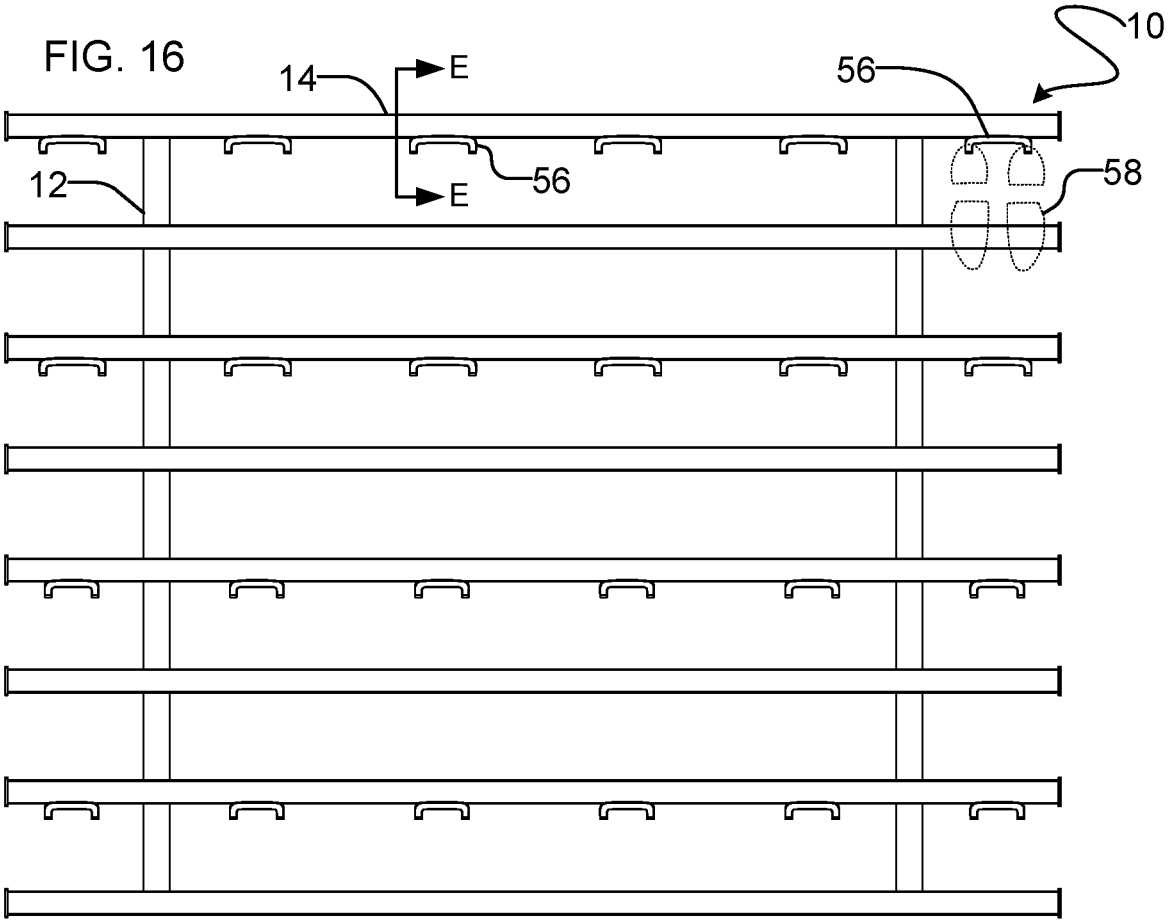
FIG. 16 shows a front view of an embodiment of an assembled organizer rack with shoe hooks.
Figure 17:
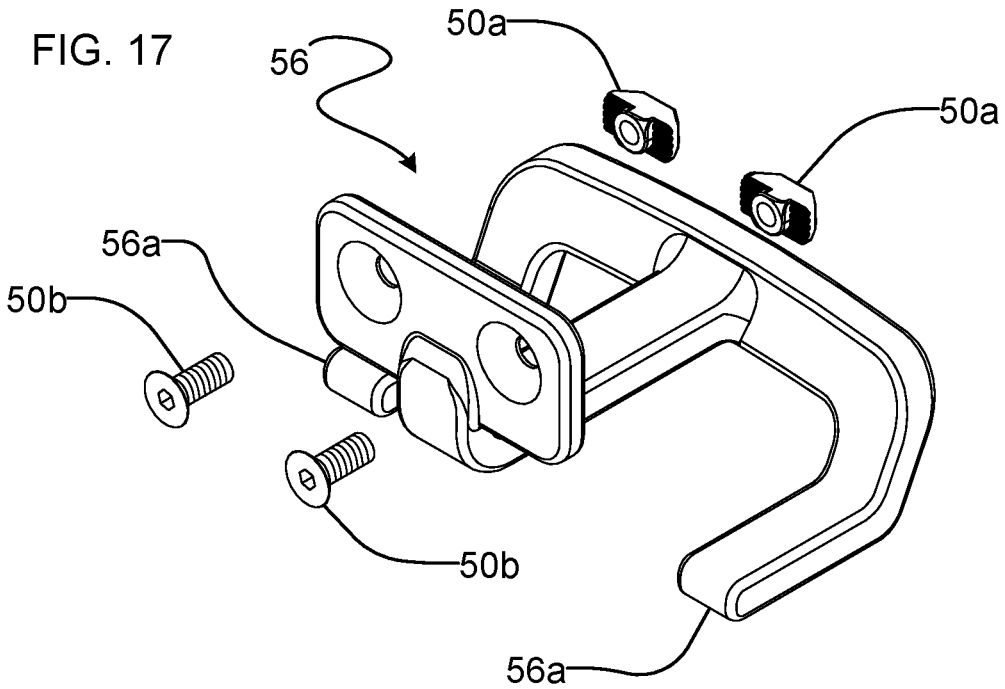
FIG. 17 shows an exploded view of an embodiment of a shoe hook.

A second example of an attachment, a coat hook 52, is shown in FIGS. 13-15. The coat hook 52 attaches to the horizontal bar through a catch mechanism 54. The operation of the catch mechanism is shown in greater detail in FIG. 15. The catch mechanism 54 uses a fixed hook 54*a* and a sliding catch 54*b*. To attach the coat hook 52 to the bar the sliding catch 54*b* is slid into a fully retracted position as shown in FIG. 15*a*. The fixed hook 54*a* can then be inserted through the channel mouth 34*a*. The coat hook 52 is then lowered so that the fixed hook 54*a* hooks onto the lower rear interior wall 34*b* of the channel 34, as shown in FIG. 15*b*. The sliding catch 54*b* can then be slid forwards into the channel 34. The sliding catch 54*b* may have a raised lip 54*c* for part or all of the length of the sliding catch (in the direction into the page in FIG. 15*c*). The sliding catch 54*b* may deflect downwards slightly when being slid in and out of the channel separately from the fixed hook 54*a*. However, when the sliding catch 54*b* is moved with the fixed hook 54*a*, the combined height of the fixed hook 54*a* and the sliding catch 54*b* prevents the coat hook 52 from being slid out through the channel mouth 34*a*. The raised lip 54*c* prevents the sliding catch 54*b* from sliding out until force is applied to slide it out deliberately.

To detach the coat hook the above steps are performed in reverse. A gap 54*d* may be present between fixed portions of the hook 52 and the sliding catch 54*b* leaving room for a tool or a person's finger to move the sliding catch 54*b*. The sliding catch 54*b* is slid out of the channel 34, the coat hook 52 is lifted so that the fixed hook 54*a* disengages the rear interior wall 34*b*, and the fixed hook 54*a* is then moved out of the channel 34. Since removal of the coat hook requires sliding the sliding catch out of the channel, it is difficult to inadvertently detach the coat hook. The coat hooks 52 can slide within the channel along the length of the bar and so can be redistributed across a bar by the user without requiring detaching the coat hooks. Additionally, the coat hooks 52 can be attached or detached by the user without requiring dismounting the organizer rack from the wall and without the use of any tools. The horizontal bar is displaced from the supporting wall by approximately the width of the vertical bar and the stanchion and therefore provides sufficient space for a person's fingers to manually operate the catching mechanism 54 without removing the organizer rack.

A third example of an attachment is provided in FIGS. 16-19. Here, a shoe hook 56 is attached to the horizontal bar using a similar T-nut attachment mechanism as described with reference to the basic hook 50 above. The shoe hook 56 provides two hook arms 56*a* that may each receive, among other possible objects, a shoe. Shoes can be hung from the hook arms with the backstay or heel tab resting on the hook arms and the top of the shoes facing away from the wall. In some arrangements of a wall organizer the horizontal bars 14 may be distributed vertically so that for a given pair of shoes hanging from a shoe hook 56 on an upper horizontal bar 14, the sole of the shoes may rest upon a lower horizontal bar, so that the shoes are not hanging freely but rest partially on the lower bar. This arrangement is illustrated by the outlines of shoe prints 58 in FIG. 16.

For each of the exemplary attachments described above it should be understood that the different types of hooks (or other support structures for suspending or supporting objects) may be used in combination with the different mechanisms for attachment into the rear channel 34, such as the plate-type attachment, T-nuts attachment and catching mechanism.

Figure 20:
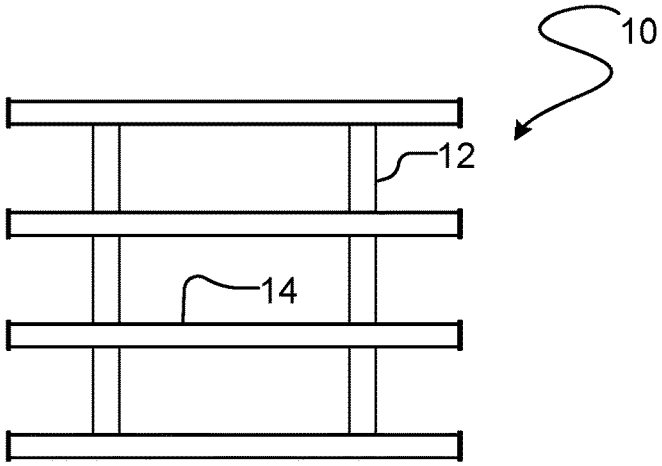
FIG. 20 is a front view of an assembled organizer rack without attachments using horizontal bars and vertical bars of a relatively short length.
Figure 21:
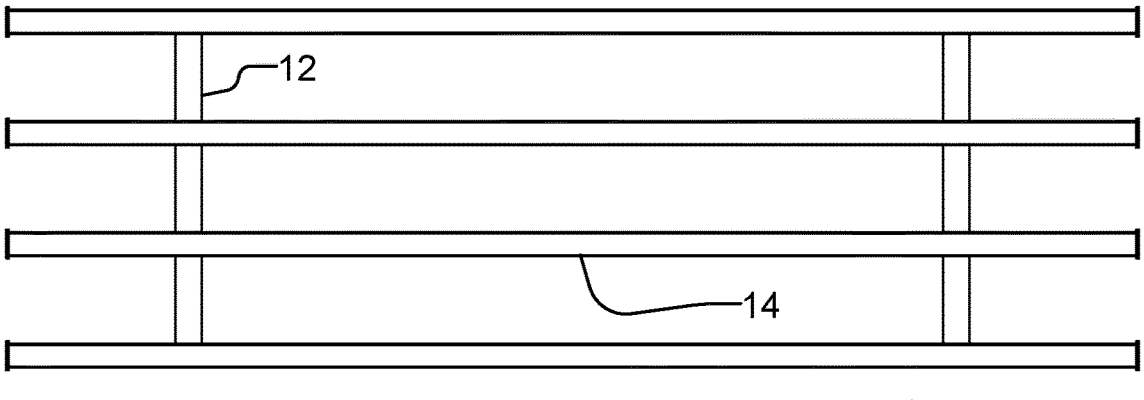
FIG. 21 is a front view of an assembled organizer rack without attachments using vertical bars of a relatively short length and horizontal bars of a relatively longer length.
Figure 22:
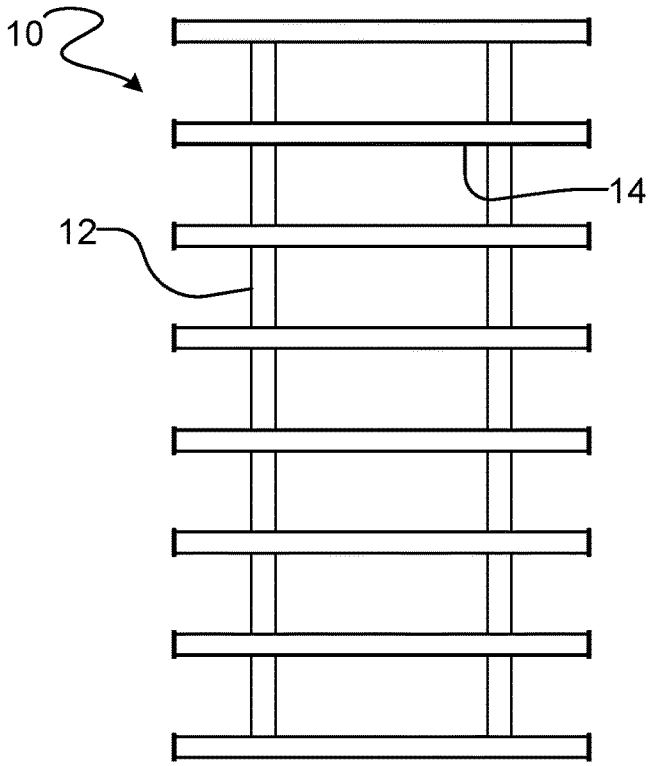
FIG. 22 is a front view of an assembled organizer rack without attachments using vertical bars of a relatively longer length and horizontal bars of a relatively shorter length.

An organizer rack could employ more than one type of attachment at one time, e.g. having one or more coat hooks, one or more shoe hooks, and one or more basic hooks. In many circumstances an organizer rack could be provided with extra attachments so that the user can choose which types and how many of each they would like to put on the assembled organizer rack. At times during the use of the rack a user could also choose to change the number, distribution and types of attachments Mounting, Dismounting and Adjusting the Organizer Rack The organizer rack can be modular in its construction, in that by appropriate choice of lengths and quantities of vertical bars and horizontal bars an organizer rack of various lengths and heights may be constructed with many shared components. FIGS. 20-22 show simple examples of how bar lengths may be mixed and matched to produce organizer racks of various sizes.

When assembling and mounting an organizer rack of an embodiment of the invention, the user may assemble the various parts of the rack, but leaving the stanchion cores separate from the stanchion exteriors, prior to mounting the organizer rack. The stanchion exteriors should be fixed to the wall at their appropriate locations by appropriate means, such as screws in suitably sturdy drywall plugs. The assembled organizer rack can then be lifted so that the stanchion cores 16*a* align with the stanchion exteriors and the stanchion cores are then inserted into the stanchion exteriors 16*b*. The stanchion pins 16*c* can then be used to fix the stanchion exteriors 16*b* to the stanchion cores 16*a*, thereby attaching the organizer rack 10 to the wall.

Figure 24:
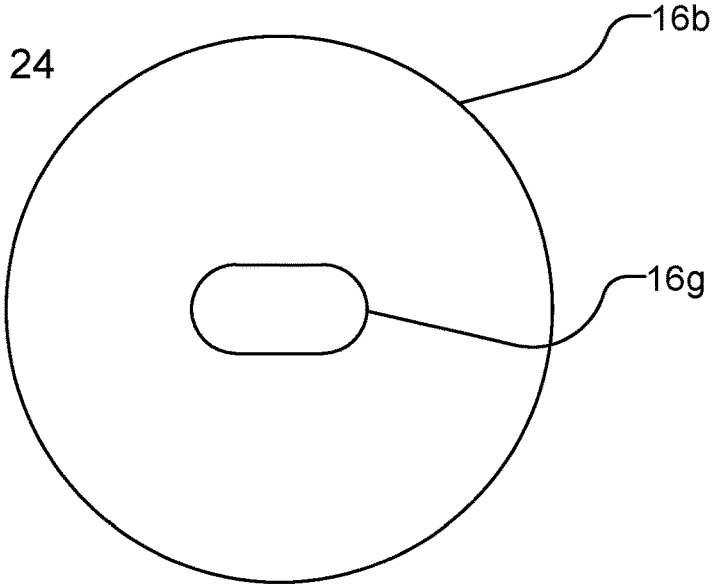
FIG. 24 is a rear view of a stanchion core according to an embodiment of the invention showing the stanchion rear aperture.

Fixing the stanchion exteriors 16*b* to the wall may be performed by a number of conventional means. For example, a drywall plug or positional anchoring device (for example, as described in U.S. Pat. No. 6,161,999) can first be embedded in a wall, the stanchion exterior is then aligned with the plug or anchoring device and a screw is inserted through the stanchion exterior rear aperture 16*g* (see FIG. 24) and into the plug or anchoring device. Fastening the screw pulls the stanchion exterior 16*b* and drywall plug or anchoring device together, fixing the stanchion exterior 16*b* to the wall.

Figure 23:
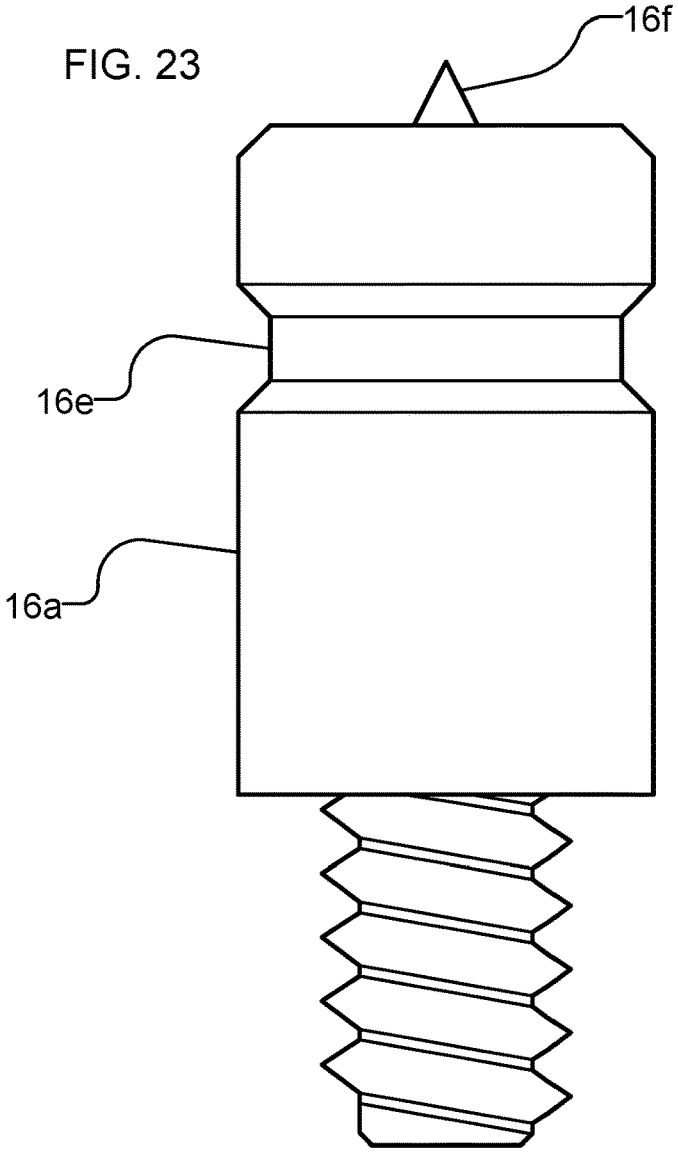
FIG. 23 is a top view of a stanchion core according to an embodiment of the invention.

In one embodiment, the stanchion cores 16*a* have a sharp protrusion 16*f* on their wall-facing end, as shown in FIG. 23. The protrusions 16*f* can allow the user to take the mostly assembled organizer rack 10 and mark the wall where they intend to mount it by pressing it into the wall. Pressing the mostly assembled organizer rack 10 into the wall presses the sharp protrusions 16*f*, leaving small indents in the wall where the stanchion exteriors 16*b* will need to be mounted. This may alleviate the need to measure out the intended locations for the organizer rack 10 by traditional means.

A wall-mounted organizer rack according to embodiments of this invention can be adjusted in size and structure at various times as desired by the user or installer. The width of an organizer rack can be shortened by cutting the horizontal bars 14 to a desired length and then covering the ends using horizontal bar end caps 38. Adjusting the width of the organizer rack may allow the user or installer to adjust the organizer rack to fit an environment with obstructions or other issues which might complicate the installation of an organizer rack of greater width. For example, an organizer rack of standard dimensions may be adjusted to fit between a light switch and a piece of furniture.

If the organizer rack has already been mounted on the wall, then if the user wants to adjust the width of the organizer rack, they can dismount the organizer rack from the wall, cut the horizontal bars to the desired length, attach the horizontal bar end caps at the ends of the shortened horizontal bars, and then remount the organizer rack.

A user or installer may also adjust the horizontal positioning of the stanchions 16 and vertical bars 12. Adjusting the horizontal positioning of the stanchions and vertical bars may be conducted in combination with, or separately from, adjusting the lengths of the horizontal bars. Adjusting the horizontal positioning of the stanchions and vertical bars may permit the user to select the length by which the ends of the horizontal bar extend past the vertical bars (the "overhang" of the horizontal bars). Adjusting the horizontal positioning of the stanchions and vertical bars may also allow the user to address issues with the anchoring of the stanchions to the wall. For example, the horizontal positioning may be adjusted to avoid a wall stud. To adjust the horizontal positioning of the stanchions and vertical bars, the organizer rack must first be dismounted form the wall if it has already been mounted. The plates 36 and plate fasteners 36*a* are then loosened to permit the vertical bar to move relative to the horizontal bar. The relative positions of the vertical bars and horizontal bars are then adjusted by sliding the bars to the desired positions and then refastening the plates. The organizer rack may then be remounted to the wall. If the relative positioning of the stanchions was adjusted during the repositioning of the horizontal and vertical bars then it may be necessary to re-fasten some of the stanchion exteriors 16*b* to the wall at the new positions.

While a number of exemplary aspects and embodiments have been discussed above, those of skill in the art will recognize certain modifications, permutations, additions and sub-combinations thereof. It is therefore intended that the following appended claims and claims hereafter introduced are interpreted to include all such modifications, permutations, additions and sub-combinations as are consistent with the broadest interpretation of the specification as a whole.

The invention claimed is:

1. An organizer rack fixable to a wall, the organizer rack comprising:

a plurality i of horizontal bars, each horizontal bar comprising a horizontal bar front wall and a horizontal bar rear central channel, and each rear central channel comprising a channel front wall and a channel mouth;

a plurality k of vertical bars, each vertical bar comprising a vertical bar front wall; and a vertical bar rear wall;

i*k bar fasteners, the bar fasteners indexed as $\{f_{n,m}: n\in\{1, 2 \ldots\}; m\in\{1, 2, \ldots k\}\}$, the $f_{n,m}$ bar fastener extending from the front wall of the mth vertical bar into the central channel of the nth horizontal bar and engaging either or both of the channel front wall and the channel mouth;

four or more stanchions fixable to the wall and extending in a rearwards direction from the rear walls of two or more of the k vertical bars;

each horizontal bar further comprising:

a pair of lateral channels, each adjacent to the rear central channel;

a pair of inserts; and a fabric cover, wherein the fabric cover is wrapped around the front wall of the horizontal bar and secured behind the horizontal bar by insertion of the inserts in to the lateral channels; and wherein a height of the channel front wall is greater than a height of the channel mouth for substantially all of a length of each horizontal bar, i is an integer greater than or equal to one, and k is an integer greater than or equal to two.

2. The organizer rack of claim 1 wherein the inserts each comprise a V-shaped portion and a height of the lateral channels is less than a spread of the V-shaped portion such that insertion of the inserts compresses the inserts and applies pressure to the lateral channel and the fabric cover.

3. The organizer rack of claim 2 wherein the inserts each comprise a roughened surface and the lateral channels each comprise a roughened surface to retain the fabric cover securely.

4. An organizer rack fixable to a wall, the organizer rack comprising:

a plurality i of horizontal bars, each horizontal bar comprising a horizontal bar front wall and a horizontal bar rear central channel, and each rear central channel comprising a channel front wall and a channel mouth;

a plurality k of vertical bars, each vertical bar comprising a vertical bar front wall; and a vertical bar rear wall;

i*k bar fasteners, the bar fasteners indexed as $\{f_{n,m}: n\in\{1, 2, \ldots\}; m\in\{1, 2, \ldots k\}\}$, the $f_{n,m}$ bar fastener extending from the front wall of the mth vertical bar into the central channel of the nth horizontal bar and engaging either or both of the channel front wall and the channel mouth;

four or more stanchions fixable to the wall and extending in a rearwards direction from the rear walls of two or more of the k vertical bars, wherein a height of the channel front wall is greater than a height of the channel mouth for substantially all of a length of each horizontal bar, i is an integer greater than or equal to one, and k is an integer greater than or equal to two; and wherein each of the bar fasteners comprises a plate and a pair of threaded fasteners, each plate having a length and a height greater than the height of the channel mouth.

5. The organizer rack of claim 4 wherein the stanchions comprise a male threaded end and one or more stanchions are fixed to one or more of the vertical bars through the rear wall of the vertical bar into a female thread of a vertical bar end cap.

6. The organizer rack of claim 4 wherein each stanchion comprises a stanchion core and a stanchion exterior, each stanchion core and stanchion exterior being fixable together by a stanchion fastener.

7. An organizer rack fixable to a wall, the organizer rack comprising:

a plurality i of horizontal bars, each horizontal bar comprising a horizontal bar front wall and a horizontal bar rear central channel, and each rear central channel comprising a channel front wall and a channel mouth;

a plurality k of vertical bars, each vertical bar comprising a vertical bar front wall; and a vertical bar rear wall;

i*k bar fasteners, the bar fasteners indexed as $\{f_{n,m}: n\in\{1, 2 \ldots i\}; m\in\{1, 2 \ldots k\}\}$, the $f_{n,m}$ bar fastener extending from the front wall of the mth vertical bar into the central channel of the nth horizontal bar and engaging either or both of the channel front wall and the channel mouth;

four or more stanchions fixable to the wall and extending in a rearwards direction from the rear walls of two or more of the k vertical bars;

an organizer rack attachment, the organizer rack attachment comprising a support structure and an attachment mechanism attachable to the channel mouth;

wherein a height of the channel front wall is greater than a height of the channel mouth for substantially all of a length of each horizontal bar, i is an integer greater than or equal to one, and k is an integer greater than or equal to two; and wherein the attachment mechanism comprises one or more T-nuts and one or more corresponding threaded fasteners wherein each T-nut has a first dimension in which it is wider than the height of the channel mouth and a second dimension in which it is thinner than the height of the channel mouth.

8. An organizer rack fixable to a wall, the organizer rack comprising:

a plurality i of horizontal bars, each horizontal bar comprising a horizontal bar front wall and a horizontal bar rear central channel, and each rear central channel comprising a channel front wall and a channel mouth;

a plurality k of vertical bars, each vertical bar comprising a vertical bar front wall; and a vertical bar rear wall;

i*k bar fasteners, the bar fasteners indexed as $\{f_{n,m}: n\in\{1, 2 \ldots i\}; m\in\{1, 2 \ldots k\}\}$, the $f_{n,m}$ bar fastener extending from the front wall of the mth vertical bar into the central channel of the nth horizontal bar and engaging either or both of the channel front wall and the channel mouth;

four or more stanchions fixable to the wall and extending in a rearwards direction from the rear walls of two or more of the k vertical bars;

an organizer rack attachment, the organizer rack attachment comprising a support structure and an attachment mechanism attachable to the channel mouth;

wherein a height of the channel front wall is greater than a height of the channel mouth for substantially all of a length of each horizontal bar, i is an integer greater than or equal to one, and k is an integer greater than or equal to two; and wherein the attachment mechanism comprises a fixed hook and a sliding catch, wherein the sliding catch can slide between a first position and a second position and in the first position a combined height of the fixed hook and the sliding catch is greater than the height of the channel mouth.

* * * * *